United States Patent [19]

Catelli

[11] Patent Number: 4,750,311

[45] Date of Patent: Jun. 14, 1988

[54] DISPENSING HEAD FOR BATCHING OPERATIONS

[75] Inventor: Camillo Catelli, Parma, Italy

[73] Assignee: Rossi & Catelli S.p.A., Italy

[21] Appl. No.: 895,889

[22] Filed: Aug. 12, 1986

[30] Foreign Application Priority Data

Aug. 30, 1985 [IT] Italy ..... 40089 A/85

[51] Int. Cl.[4] ..... B65B 43/40; B65B 7/28; B67B 1/00; B67B 7/02

[52] U.S. Cl. ..... 53/281; 53/468; 53/283; 53/381 A

[58] Field of Search ..... 53/381 A, 270, 281, 53/283, 468, 88, 94, 109, 167

[56] References Cited

U.S. PATENT DOCUMENTS

| | | | |
|---|---|---|---|
| 4,363,338 | 12/1982 | Brown | 53/381 A X |
| 4,452,030 | 6/1984 | Inada | 53/468 X |
| 4,494,363 | 1/1985 | Rica et al. | 53/88 X |
| 4,522,089 | 6/1985 | Alvi | 53/381 A X |
| 4,524,563 | 6/1985 | Sassi | 53/468 X |

*Primary Examiner*—Horace M. Culver
*Attorney, Agent, or Firm*—Darby & Darby

[57] ABSTRACT

The dispensing head disclosed comprises a chamber (2) with a bottom outlet (3), and a coaxial hollow plunger (8) the bottom end of which carries a plug (10) that registers in the outlet. The plunger is capable of axial shift between a raised position, and a lowered position in which the plug (10) blocks the outlet (3); on completion of the single batching cycle, the plug is lowered into the outlet and pressurized inert gas is directed through the plunger. The head also comprises a poppet (16) capable of axial movement between a raised position, in which it registers in the bore (11) of the plug (10), and a lowered position in which it is distanced from the mouth of the bore; the poppet is fixed to the bottom end of a slender stem (17) accommodated within the hollow plunger (8), and reciprocated in such a way that it keeps the bore (11) normally closed, and is moved into the lowered position only when the plug (10) happens likewise to be in its lowered position.

12 Claims, 3 Drawing Sheets

DISPENSING HEAD FOR BATCHING OPERATIONS

BACKGROUND OF THE INVENTION

The invention disclosed relates to an improved dispensing head of the type used for batching foodstuffs under aseptic conditions, in particular, products of a paste-like consistency such as tomato puree.

The prior art embraces dispensing heads that comprise a vertically disposed chamber provided with a bottom outlet through which a product is fed into a container; such a container will be fashioned in a flexible material and pre-sterilized, and can hold several liters of the product. Positioned internally of and coaxial with the chamber, one has a vertical hollow plunger with a plug at bottom that registers in the outlet. Such a plunger can be shifted between two positions: raised, with the plug distanced from the outlet, and lowered, with the plug locating in and thus blocking the outlet.

The plug will normally occupy the raised position, in particular when the product is batched into the container, and on completion of the filling operation, move into the lowered position whereupon inert gas is caused to flow under pressure into the bore of the plunger. The effect of such a step is that residual foodstuff clinging to the outlet will be pushed into the container, and the internal surface of the outlet is thus maintained free of matter that might become contaminated during changeover of the container, or putrefy if allowed to linger in the outlet for any length of time.

The plug also keeps the outlet closed off during changeover of the container, thereby keeping the chamber separate from the surrounding environment.

Problems nevertheless occur in the prior art embodiment described above, due to blockages caused by residual foodstuff that accumulates in the bore of the plug. Passage of the inert fluid through the bore is obstructed, if not totally impeded, by the accumulated matter, thus jeopardizing the plug's efficient operation; what is more, such accumulated foodstuff necessarily becomes exposed to the surrounding environment during changeover of the container, and one has the risk of putrefaction.

Drawbacks are likewise in evidence where the dispensing head is used to fill containers that have undergone an internal pre-sterilization and are thus offered to the head with stopper already inserted. The dispensing head is provided with appropriate means that remove the stopper from the neck of the container prior to its being filled, and replace it thereafter. Such means are located internally of an aseptic enclosure in which sterilizing fluid is held at pressure marginally above atmospheric, and which encapsulates the bottom outlet of the chamber. The base of the enclosure is provided with an opening, coaxial with the chamber outlet, for the purpose of accommodating the neck of the container.

The drawbacks in question arise from the fact that the outer surfaces of the stopper and the neck of the container will have been exposed to the surrounding environment, and when offered ultimately to the dispensing head, may be contaminated to a degree against which the sterilizing power of the enclosure is insufficient.

The object of the invention, accordingly, is that of overcoming the problems and drawbacks encountered with prior art type dispensing heads.

SUMMARY OF THE INVENTION

The stated object is achieved with a dispensing head according to the invention, the embodiment of which is such as to render aseptic batching operations more dependable, and to ensure increased speed, improved function and better reliability of components implementing the various operations that involve manipulation of the neck and stopper of the container, namely, laying hold of the neck, removing the stopper, locating the neck of the container over the chamber outlet, replacing the stopper in the neck, and removing the container.

BRIEF DESCRIPTION OF THE DRAWINGS

The invention will now be described in detail, by way of example, with the aid of the accompanying drawings, in which.

DESCRIPTION OF THE PREFERRED EMBODIMENT

Figure 1:
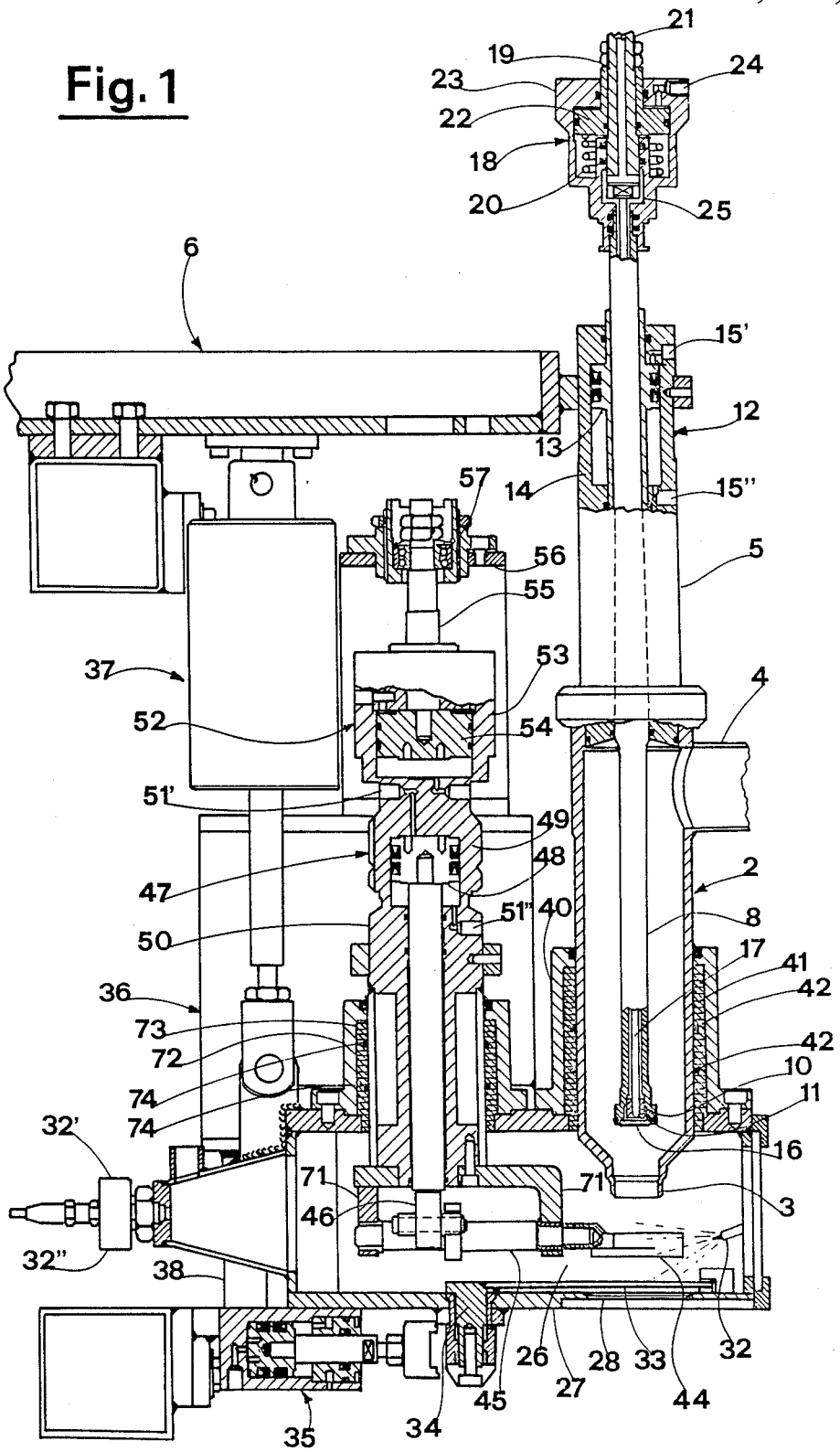
FIG. 1 shows a vertical section through the dispensing head disclosed.

With reference to the drawings, 2 denotes a chamber from which a foodstuff is dispensed into a container. The chamber 2 is of substantially cylindrical shape, its axis vertically disposed, and exhibits a bottom end that tapers into an outlet 3 of essentially cylindrical shape, through which foodstuff is batched into the container. The top end of the chamber 2 connects with an inlet 4 through which foodstuff flows into the head.

5 denotes a cylindrical column associated immovably with the top of the chamber 2; the chamber is thus carried by the column, and the column in its turn attached permanently to and carried by an upper frame 6 that supports the entire dispensing head.

8 denotes a hollow plunger located internally of the chamber 2 and coaxial therewith, which occupies the full length of the chamber 2 and extends through and beyond the top end of the cylindrical column 5. The hollow plunger 8 is integral at bottom with a plug 10 the diameter of which is marginally greater than that of the rest of the plunger 8; the dimensions of the plug 10 are such that it registers exactly in the outlet 3.

Figure 2:
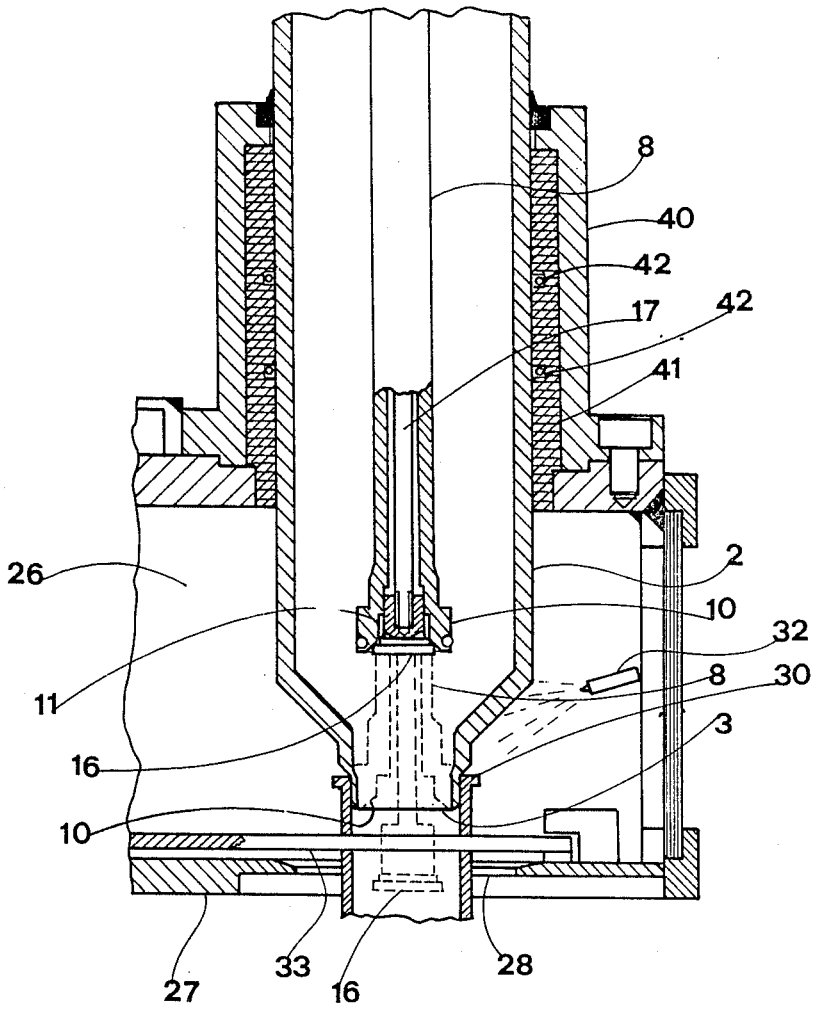
FIG. 2 is the large scale drawing of a detail of the head shown in FIG. 1, showing the chamber outlet 3 located in the container neck 30.
Figure 3:
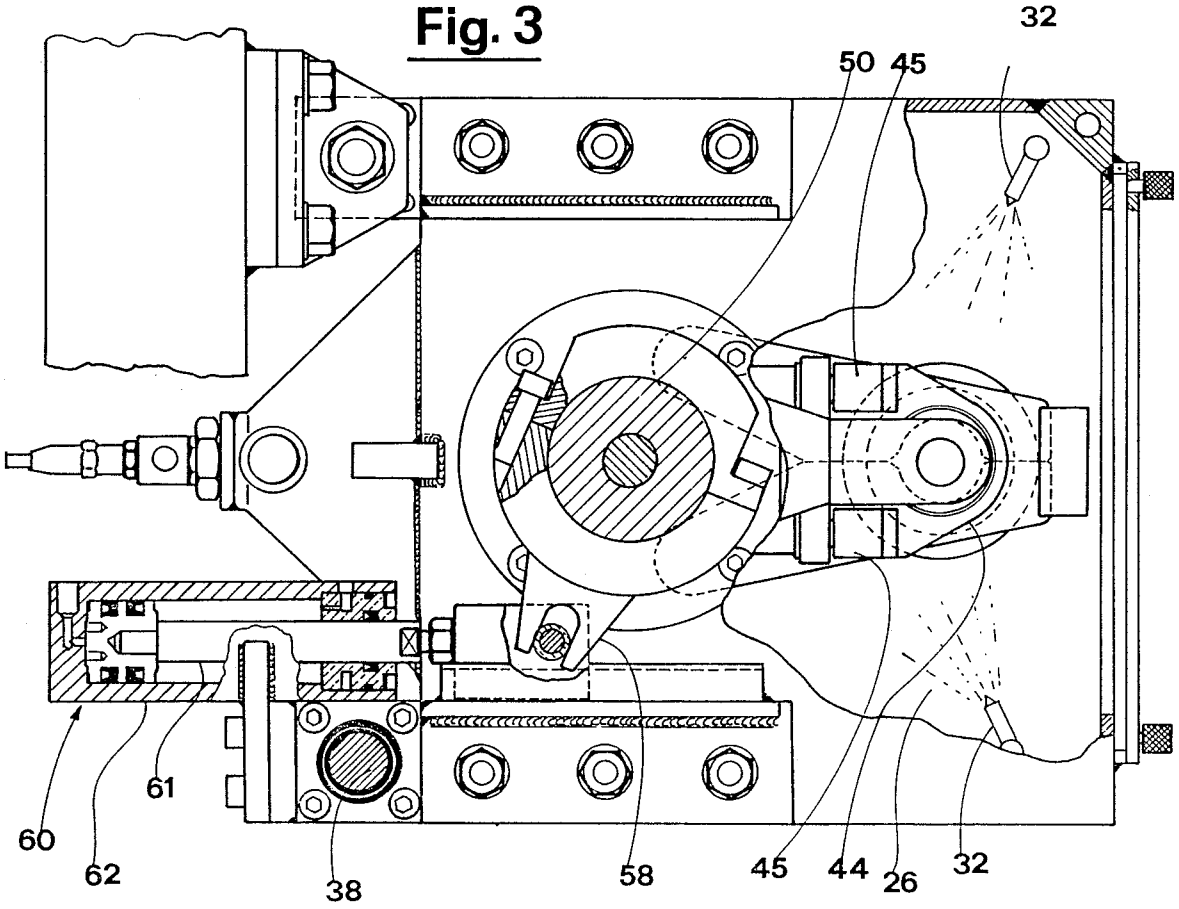
FIG. 3 is the section through III—III in FIG. 1.

The hollow plunger 8 is capable of movement in a vertical direction, along its own axis, between a raised position (illustrated by the regular line in FIG. 2), in which the plug 10 is held at a given distance above the outlet 3, and a lowered position (illustrated by the broken line in FIG. 2) in which the plug 10 registers in and blocks the outlet 3. The movement in question is produced by means of a double acting fluid power cylinder 12 located at the top of the cylindrical column 5; the piston 13 of the cylinder 12 ensheaths and moves as one with the hollow plunger 8, and the barrel 14 is integral with the column 5 itself. The fluid (compressed air) used to drive the piston 13 enters and leaves the top and bottom chambers of the cylinder by way of respective ports 15' and 15''.

11 denotes a cylindrical bore located in the plug 10, which is splayed at the bottom end and accommodates a poppet 16 of dimensions such as to fit into and occlude the bore 11. More precisely, the poppet 16 comprises a cylindrical body that slides to an exact fit against the cylindrical surface of the bore 11, and a skirt immediately beneath the cylindrical body that registers against the splayed mouth of the bore 11.

The poppet 16 is attached to the bottom end of a stem 17 that passes through the bore of the hollow plunger 8 and extends from its top end; the difference in diameter between the stem 17 and the bore of the plunger 8 will be sufficient to avoid occlusion of the bore.

The poppet 16 can be shifted within and in relation to the bore 11 of the plug 10 from a raised position, in which the bore 11 is blocked, to a lowered position in which the poppet will be located at a given distance below the mouth of the bore 11. Shift into the lowered position is produced by a single acting fluid power cylinder 18; return to the raised position is obtained by way of a spring 20.

The top end of the stem 17 is made fast to the bottom end of a rod 21, of greater diameter than the stem 17, which passes through the cylinder 18; the piston 22 of the cylinder 18 ensheaths the rod 21 in a coaxial fit and strokes thus internally of a barrel 23 rigidly attached to and supported by the hollow plunger 8. The top chamber of the cylinder 18 receives fluid (compressed air) by way of a port 24; the bottom chamber houses the return spring 20.

The piston rod 21 is hollow, with an axial bore 19 the bottom end of which emerges into a void 25 created in the barrel 23 for the purpose of housing the top end of the stem 17. The top end of the piston rod 21 (not illustrated) connects with means for the introduction of an inert gas (e.g. nitrogen) that flows into the void 25, thence down through the bore of the plunger 8.

26 denotes an aseptic enclosure located beneath the chamber 2; and more exactly, an environment pressurized with sterilizing fluid to a degree marginally above atmospheric. This enclosure 26 encapsulates the tapered bottom end of the chamber 2 and its outlet 3, as well as surrounding a generous stretch of the cylindrical chamber wall.

The base 27 of the enclosure 26 exhibits a substantially circular opening 28 which is coaxial with the chamber outlet 3 and is of size such as to admit the neck 30 of a container; thus, the only point of communication between the enclosure 26 and the surrounding environment is that provided by the opening 28. The side of the enclosure 26 farthest from the opening 28 is provided with inlets 32' and 32" serving for the injection of sterilizing fluid, and of sterile air pressurized to a level marginally above atmospheric.

At least two jets 32 are provided internally of the enclosure 26, located one at either side of the outlet 3 and set such as to give a substantially radial bearing on the bottom opening 28. The jets 32 connect with a supply of sterilizing fluid.

The enclosure 26 houses means located alongside its bottom opening 28 that serve to hold the neck 30 of a container in position, once inside the enclosure. Such means consist essentially in a pair of horizontal grips 33 (conventional in embodiment) that are rotatable about a fixed vertical pivot 34 mounted to the base 27 of the enclosure, and operated by a cylinder 35 in such a way as to lay hold on the outside of the neck 30 of a container inserted through the opening 28. The cylinder 35 itself is located beneath the enclosure 26, mounted to a lower frame 36 that can be moved in relation to the upper frame 6 through a vertical path in order to assume two positions: raised, with the neck 30 of the container held fast by the grips 33 and urged forcibly over the chamber outlet 3, and lowered, with the neck 30 held fast by the grips 33 and distanced from the outlet 3; movement between the two positions is produced by a fluid power cylinder 37 interconnecting the upper frame 6 and the lower frame 36. Guide posts 38 ensure faultless parallel movement of the lower frame 36.

The enclosure 26 moves as one with the lower frame 36, and the need thus arises for a sliding fit with the outer surface of the chamber 2; fluid-tight conditions are ensured by means of a sleeve 40 which ensheaths a bushing 41 breasted in sliding contact with the outer surface of the chamber 2 and incorporating seals 42.

Also located internally of the enclosure 26 are means for removal of the stopper from the neck of a container, and for its subsequent replacement. The means in question comprise a pair of horizontal grips 44 shaped such as to enable their laying hold on the stopper, each of which rotates about a respective horizontal pivot 45; the two pivots 45 are disposed parallel one with the other and occupy a plane substantially coincident with the top surface of the stopper. The grips 44 are spread apart and brought together by a crank mechanism which is operated by the bottom end of a vertical rod 46 reciprocated through its own axis by a vertically-disposed fluid power cylinder 47, the piston 48 of which is attached to the top end of the rod 46 and strokes internally of a barrel 49 integral with a vertical trunk 50; the rod 46 is slidably accommodated within the bottom section of this trunk 50. Fluid driving the piston 48 enters and leaves the top and bottom chambers of the cylinder 47 by way of respective ports 51" and 51".

The bottom end of the trunk 50 extends into the aseptic enclosure 26, and carries arms 71 to which the horizontal pivots 45 are attached; thus, operation of the cylinder 47 reciprocates the rod 46 through a vertical path in such a way as to rotate the pivots, spreading the grips 44 and bringing them together accordingly.

52 denotes a further vertical fluid power cylinder the barrel 53 of which is incorporated into the top section of the trunk 50; the piston 54 of this cylinder is connected to a vertical rod 55 the top of which is attached to a plate 56 forming part of the lower frame 36. With the cylinder 52 in nonoperative state, the weight of the top end of the barrel 53, which is integral with the trunk 50, will bear down on the piston 54, which is connected to the plate 56, and the weight of the entire trunk 50 is thus carried by the piston 54. When pressurized fluid enters the top chamber of the cylinder 52, the barrel 53 is lifted from the piston 54, hence from the lower frame 36, such that both the trunk 50 and the grips 44 rise as one to adopt a new position in relation to the lower frame 36 and the enclosure 26. The purpose of the cylinder 52 is that of shifting the grips 44 from a lowered position into a raised position directly above; in their lowered position, the grips 44 are stationed on a level corresponding to the height gained by a stopper occupying the neck 30 of a container when clamped by the relative grips 33 with the enclosure 26 in its lowered position. In reaching the raised position, the grips 44 will be lifted through a distance greater than the depth of the stopper.

The rod 55 is connected to the plate 56 by way of a thrust bearing 57 in order to permit of the rod's being rotated about its own axis; it will be observed that the axes of the two rods 55 and 46 coincide. In effect, the entire trunk 50 can swivel bodily between a first position, in which the grips 44 are stationed directly above the opening 28 in the base of the enclosure, and a second position, in which the grips 44 are stationed to one side of the opening 28 so as not to obstruct vertical movement of the neck 30 of the container. Rotational movement is imparted by way of a lever 58 integral with the trunk 50, which is worked by the rod 61 of a horizontally disposed fluid power cylinder 62 mounted to and moving as one with the lower frame 36.

Moving between positions, the trunk 50 must necessarily slide in relation to the enclosure 26; accordingly, the requisite fluid-tight fit will be ensured by a sleeve 72 that ensheaths a bushing 73 breasted in sliding contact with the outer surface of the trunk 50 and accommodating seals 74.

Operation of the dispensing head will now be described.

Assuming a container full of the foodstuff in process to have been removed from the head, the plug 10 will be in the lowered position, blocking the chamber outlet 3, and the poppet 16 in raised position, blocking the bore 11 of the plug 10; the aseptic enclosure 26 will be in lowered position, the stopper grips 44 will be spread and stationed directly above the opening 28, likewise in lowered position, and the neck grips 33 will be spread.

At this point, the neck 30 of a fresh container, occupied by its stopper, will be inserted through the opening 28 and into the enclosure 26 by appropriate auxiliary means of conventional type, which are not illustrated.

The cylinder denoted 35 now operates so as to bring together the relative grips 33, which lay hold on the neck 30 of the container, making contact with its outer surface at a point below the section occupied by the stopper; the cylinder denoted 47 also operates, raising the rod 46 which brings about closing movement of the stopper grips 44. This done, the cylinder denoted 52 is pressurized, and the entire trunk 50 rises, lifting the grips 44 into their raised position and withdrawing the stopper from the neck 30 of the container as a result.

The cylinder denoted 60 is now operated, and the trunk 50 swivels bodily in such a way as to move the grips 44 and stopper to one side of the container neck 30, avoiding contact that would otherwise occur during subsequent movement of the neck 30 in the vertical plane.

Next, the cylinder denoted 37 operates so as to raise the enclosure 26, and with it, the neck 30 of the container, thereby bringing the neck into the raised position which finds it forced with a certain amount of pressure over the chamber outlet 3.

During the steps of locating the neck 30 of the container in the bottom opening 28, removing the stopper, and offering the neck to the outlet 3, the jets 32 will be operated. The position of the jets is such as to invest the stopper and the outer surface of the neck with sterilizing fluid, and such an action is especially advantageous when one considers that the outer surfaces of stopper and neck will not be sterile, having been exposed to the atmosphere, and that the sterile environment created within the enclosure 26 will not normally be sufficient to render them such; the jets 32, on the other hand, begin operating even before the stopper and neck of the container gain the inside of the enclosure 26.

Next, the cylinder denoted 12 is operated to the end of raising the plunger 8 and removing the plug 10 from the outlet 3; this naturally will raise the cylinder 18 attached to the top of the plunger.

At this juncture, batching can take place; foodstuff entering the chamber 2 via the inlet 4 is allowed to descend through the chamber and pass into the container by way of the outlet 3.

With the container filled, both cylinders 12 and 18 will operate, taking the plug 10 and the poppet 16 into their relative lowered positions whereby the outlet 3 is blocked, and the bore 11 of the plug 10 vacated, respectively. Pressurized inert gas is now forced through the bore 19 of the rod 2 and into the hollow plunger 8, from which it exits by way of the bore 11 of the plug, and thus removes any foodstuff that may have lodged in the chamber outlet 3. The cleansing action is rendered complete by the plug 10 which, registering in the outlet 3, scrapes the bottom part of its internal surface clean.

This accomplished, the poppet 16 will be returned to the raised position in which it blocks the bore 11 of the plug 10.

The cylinder denoted 60 is now operated such that the trunk 50 can swivel back to the position in which the stopper is located above the neck 30 of the container, before descending upon depressurization of the relative cylinder 52 in order to bring the stopper grips 44 down to the level at which the stopper itself is replaced in the neck of the newly filled container.

The vertical rod 46 is now urged downwards by operation of the relative cylinder 47, causing the grips 44 to spread and release the stopper, and operation of the horizontal cylinder 35 at bottom spreads the grips 33 hitherto clamping the container neck 30. The full container can then be removed by conventional auxiliary means (not illustrated).

At this point, the cycle is complete, and the configuration of the dispensing head is the same as that described at the outset, ready to receive a fresh container.

It will be observed that the action produced by the poppet 16 is especially useful, inasmuch as it prevents the bore 11 of the plug 10 from becoming obstructed by the foodstuff handled. It will also be clear that the mechanical embodiment of a dispensing head according to the invention is such as to ensure high levels of dependability, precision and efficiency in operation. Finally, addition of the jets 32 gives a more complete sterilization, and the effectiveness of aspetic conditions created internally of the dispensing head is enhanced as a result.

What is claimed:

1. An arrangement for batching food products under aseptic conditions, comprising a main chamber receiving at least a neck of a container, said main chamber defined by its walls, a first chamber having an inlet and outlet, said outlet of the first chamber communicating with said main chamber, a plunger disposed within the first chamber and closely received by inside walls of the outlet of the first chamber, first moving means for movement of said plunger within the first chamber, said first moving means positioned outside said main and first chambers, removal means for removing a stopper from a neck of the container, said removal means having a pair of grips positioned within the main chamber and rotatable by pivots, said pivots are operated by a rod having reciprocal movement along a longitudinal axis thereof, said rod actuated by second moving means situated outside said main chamber in such a manner that said rod and second moving means are substantially isolated from the main chamber;

said main chamber is movable by third moving means along said longitudinal axis of the first chamber from an upper to a lower position, in the upper position the neck of the container engages with the outlet of the first chamber, in the lower position the neck of the container is located below said outlet of the first chamber, said third moving means situated substantially outside the main chamber.

2. An arrangement for batching food products under aseptic conditions according to claim 1, wherein said first chamber is situated within the walls of said main chamber.

3. An arrangement for batching food products under aseptic conditions according to claim 2, wherein said rod and said second moving means are situated within the walls of said main chamber.

4. an arrangement for batching food products under aseptic conditions according to claim 1, wherein said plunger is connnected with a supply of pressurized inert gas and is capable of moving along the longitudinal axis thereof between a raised position, in which the plug is distanced from the first chamber outlet and a lowered position in which the plug engages with the outlet, wherein the plug remains in raised position during batching of the food into the container, and is in the lowered position following completion of the batching operation, whereupon said pressurized inert gas is forced through an axial bore of the plunger.

5. An arrangement for batching food products under aseptic conditions according to claim 4, wherein a poppet of the plunger is adapted to engage with a bore of a plug and being capable of shifting with the plug between the raised position, blocking the bore of the plug, and the lowered position distancing from the mouth of the bore.

6. An arrangement for batching food products under aseptic conditions according to claim 5, wherein a stem of the plunger is accommodated by the bore of the hollow plunger, the bottom end of which is attached to a poppet, and operation of the stem produces shift of the poppet.

7. An arrangement for batching food products under aseptic conditions according to claim 6 further comprising means for producing shift of the poppet, said means operated in such a way that the bore of the plug remains blocked, and the poppet is shifted into lowered position only when the plug occupies its lowered position.

8. An arrangement for batching food products under aseptic conditions according to claim 7, wherein said means for producing shift of the poppet comprises a single acting fluid power cylinder having spring return and a piston is attached to a top end of the stem.

9. An arrangement for batching food products under aseptic conditions according to claim 1, wherein said main chamber having at least one jet connected with a supply of sterilized food and positioned at one side of the outlet of the first chamber.

10. An arrangement for batching food products under aseptic conditions according to claim 1, wherein said main chamber contains the sterilizing fluid and is maintained at a pressure above mospheric and is provided with an opening at a lower portion thereof for receiving the neck of the container.

11. An arrangement for batching food products under aseptic conditions according to claim 1, further comprising means which clamp the neck of a container in a position within the main chamber having at least two substantially horizontal grips rotatable about a substantially vertical pivot, said grips are attached to a bore of the main chamber, a cylinder permanently attched to the main chamber and designed to spread the grip apart and to draw the grips together in such a way that a contact is made with the lateral surface of the container neck.

12. An arrangement for batching food products under aseptic conditions according to claim 1, wherein said means for removal of the stopper further comprises a crank mechanism operated by the substantially vertical rod, a substantially vertically disposed fluid power cylinder, having a piston attached to the top end of the rod and providing its reciprocation, a barrel having a piston, trunk integral with the barrel of the cylinder, a bottom portion of the trunk accommodated an axial slide of the rod and extends slidably into the main chamber, carrying arms receiving horizontal pivots in such a way that operation of the cylinder spreads the grips and draw them together;

a substantially vertically disposed fluid power cylinder incorporated into a top section of the trunk and comprising a barrel integral with the trunk, and a piston;

a substantially vertically rod, a bottom end of the substantially vertical rod is attached to the piston which is attached by way of its top end to a plate that constitutes part of the moving frame rotatable about its own axis in such a way that operation of the cylinder shifts the grips from a lowered position into a raised position, in the lower position the grips are stationed at a level corresponding to the height of a stopper receiving the neck of a container when clamped by the relative grips, in the raised position the grips are lifted substantially vertically through a distance greater than the depth of the stopper, a substantially horizontally disposed fluid power cylinder rotating the trunk about its own axis between a position in which the grips are stationed directly above the opening in the base of the main chamber, the position in which the grips are stationed at one side of the opening is such that vertical movement of the neck of the container is not obstructed.

* * * * *